US008756885B1

(12) United States Patent
Mathews et al.

(10) Patent No.: US 8,756,885 B1
(45) Date of Patent: Jun. 24, 2014

(54) POST-TENSIONING ANCHORAGE WITH EQUALIZED TENDON LOADING

(75) Inventors: Thomas F. Mathews, Fort Worth, TX (US); Stanley A. Landry, Euless, TX (US); Paul A. Hohensee, West Bend, WI (US)

(73) Assignee: Actuant Corporation, Menomonee Falls, WI (US)

( * ) Notice: Subject to any disclaimer, the term of this patent is extended or adjusted under 35 U.S.C. 154(b) by 0 days.

(21) Appl. No.: 13/420,207

(22) Filed: Mar. 14, 2012

Related U.S. Application Data

(60) Provisional application No. 61/452,447, filed on Mar. 14, 2011.

(51) Int. Cl.
*E04C 5/08* (2006.01)

(52) U.S. Cl.
USPC ..... 52/223.13; 52/223.6; 403/369

(58) Field of Classification Search
USPC ..... 52/223.13, 223.14, 223.6, 231; 403/374.1, 368, 369; 405/259.4
See application file for complete search history.

(56) References Cited

U.S. PATENT DOCUMENTS

| | | | | |
|---|---|---|---|---|
| 2,783,673 | A * | 3/1957 | Lewis et al. | 411/53 |
| 3,937,607 | A * | 2/1976 | Rodormer | 425/111 |
| 5,141,356 | A * | 8/1992 | Chaize | 403/368 |
| 6,017,165 | A | 1/2000 | Sorkin | |
| 6,234,709 | B1 * | 5/2001 | Sorkin | 403/374.1 |
| 8,214,997 | B2 * | 7/2012 | Richie | 29/522.1 |
| 2009/0205273 | A1 | 8/2009 | Hayes et al. | |

* cited by examiner

*Primary Examiner* — Jeanette E Chapman
*Assistant Examiner* — Daniel Kenny
(74) *Attorney, Agent, or Firm* — Quarles & Brady LLP

(57) ABSTRACT

A wedge for a concrete post-tension reinforcement anchorage system is shaped such that the compressive force on the tendon after tensioning of the anchorage system is substantially evenly distributed over a length of the outer surface of the tendon that is engaged by the internal surface of the wedge. The external surface of the wedge may have a first section with a first taper angle and a second section with a second taper angle, the second taper angle being larger than the first taper angle. The internal surface of the wedge may have a first section with a first taper angle and a second section with a second taper angle, the second taper angle being greater than the first taper angle. An anchor with a bore with two taper angles and tooth profiles of threading patterns on the internal surface of the wedge are also disclosed.

20 Claims, 6 Drawing Sheets

POST-TENSIONING ANCHORAGE WITH EQUALIZED TENDON LOADING

CROSS REFERENCE TO RELATED APPLICATIONS

This application claims the benefit of U.S. Provisional Patent Application No. 61/452,447 filed Mar. 14, 2011, the disclosure of which is hereby incorporated by reference for all purposes.

STATEMENT OF FEDERALLY SPONSORED RESEARCH OR DEVELOPMENT

Not applicable.

FIELD OF THE INVENTION

The present invention relates to a system for providing concrete with post-tensioned reinforcement. More specifically, the invention relates to the shape of the internal and external surfaces of the wedge, differing taper angles between the external wedge surface and the bore of the anchor, the use of different thread patterns and tooth profiles on the internal surface of the wedge, and differing taper angles on the bore of an anchor to provide an anchoring system that has a high level of performance.

BACKGROUND PRIOR ART

Concrete is capable of withstanding significant compressive loads, however, it is not as capable of withstanding significant tensile loads. Thus, it is often necessary to reinforce concrete structures with steel bars, cables, or the like to enhance the structure's ability to withstand tensile forces.

The basic principles of providing such reinforcement to concrete structures are known in the prior art. In a post-tensioned reinforcement system, several steel cables (called "tendons") are placed within the concrete framing structure where the concrete will later be poured around them. The tendons are formed of several high tensile strength steel wires wound in a helical pattern around a centrally positioned steel wire. When the tendons are placed within the framing structure, each tendon is held loosely in place, and the ends of each tendon pass through an anchor on each end of a concrete member that composes a portion of the total concrete structure. Once the concrete is poured and has cured for a sufficient amount of time, but not yet to the point of being fully cured, the tendons may be tensioned by a hydraulic tensioner. The hydraulic jack tensioners that may be used in these circumstances are driven by high pressure hydraulic fluid in one or more cylinders in the tensioner, which places the tendon under a high tensile load, for example 30-40,000 pounds force.

A concrete anchor is typically formed as a singular body by casting, forging, or machining and includes a body portion, two generally cylindrically shaped portions, one extending from the front surface of the flange (nose portion) and one extending from the rear surface of the flange (button portion). The front surface of the flange commonly has multiple ribs to help support the force applied to the tendon after tensioning. The rear surface of the flange is used to contact the concrete or other structural surface and provide a load bearing surface during the tensioning of the tendon by the hydraulic jack tensioner. The flange portion typically includes two mounting holes so the anchor can be fastened to the concrete structure, with nails or similar fasteners. Other anchor configurations constructed of multiple bores, separate components for bore holes and concrete bearing flange portions, and with or without nose and button portions are also used.

A bore passes through the nose portion, the flange portion, and the button portion and decreases in diameter along the axis of the bore in the direction from the front surface of the flange to the rear surface of the flange. Due to this decreasing diameter, or tapering, the bore is capable of receiving a wedge that surrounds the tendon. A common taper angle for anchor bores of the prior art is 7°.

Before the concrete is poured around the tendons, each tendon must pass through an anchor that will be located on each side of where the concrete slab will eventually be located. The tendon enters the anchor by entering the bore in the button portion on the rear surface of the flange and exiting the bore in the nose portion on the front surface of the flange. After the tendon exits the anchor, the wedge may be placed around the tendon in the frusto-conical bore of the anchor.

The wedge is generally frusto-conical in shape and is usually composed of two or more segments. The internal surface of the wedge has a gripping structure for gripping the tendon. The outer surface of the wedge engages the bore of the anchor, and as such, the outer surface of the wedge generally matches the taper angle of the bore of the anchor. Therefore, wedges are constructed such that the outer diameter decreases from the front of the wedge to the rear of the wedge.

After the concrete is poured and allowed to partially cure for a sufficient amount of time, the tendon may be tensioned by a hydraulic jack tensioner. When the tendon is tensioned by the hydraulic jack tensioner, the tendon and wedge are forced tightly into the bore. The tensioning force on the tendon passes to the wedge and to the nose, button, and flange portions of the anchor, and ultimately, to the concrete slab. The ribs help distribute that force throughout the body of the anchor and onto the rear surface of the flange portion of the anchor, thus providing the tensile strength to the concrete structure.

While anchor systems and the various components that compose them have been subject to minor changes, the efficiency of anchor systems have stayed rather constant since their inception. In fact, the average overall efficiency of a current anchor system, as measured by the tensile strength at failure compared to the ultimate tensile strength of the tendon, is approximately 95%. With the widespread use of anchor systems in the construction of concrete structures, any improvement in anchor systems will help to maintain the integrity of concrete structures and lead to longer life spans for such structures. In addition, obtaining a more efficient anchorage system would prove especially beneficial for structures built in environments that have a greater likelihood of seismic activity.

SUMMARY OF THE INVENTION

The present invention provides for components to create a high performance anchorage system for post-tensioned concrete by describing the shape of the external and internal surfaces of a wedge, various thread patterns and tooth profiles in the wedge, and the shape of a bore of an anchor, all which help to more evenly distribute the compressive force of the wedge on the tendon that occurs in an anchor for post-tensioned reinforcement of concrete.

In one aspect, the invention provides for a wedge for an anchorage system for post-tensioned concrete reinforcement for an anchorage system including a tendon and an anchor. The anchor has a flange with a front surface and a rear surface. The anchor has at least one wedge receiving bore, the wedge receiving bore having a tapered interior surface. The wedge receiving bore extends through the flange portion of the anchor. The wedge comprises an internal surface configured to engage an outer surface of the tendon and an external surface configured to engage the tapered interior surface of the wedge receiving bore of the anchor. The external surface includes a first section with a first taper angle and a second section with a second taper angle. The first section is near a front side of the wedge and the second section is near a rear side of the wedge. The first taper angle is defined by the angle between an imaginary line extending from the first section and a longitudinal axis of the wedge. The second taper angle is defined by the angle between an imaginary line extending from the second section and a longitudinal axis of the wedge. The second taper angle is larger than the first taper angle.

In another aspect, the invention provides for a wedge for an anchorage system for post-tensioned concrete reinforcement for an anchorage system including a tendon and an anchor. The anchor has a flange with a front surface and a rear surface. The anchor has at least one wedge receiving bore, the wedge receiving bore having a tapered interior surface. The wedge receiving bore extends through the flange portion of the anchor. The wedge comprises an internal surface configured to engage an outer surface of the tendon and an external surface configured to engage the tapered interior surface of the wedge receiving bore of the anchor. The internal surface includes a first section with a first taper angle and a second section with a second taper angle. The first section is near a front side of the wedge and the second section is near a rear side of the wedge. The first taper angle is defined by the angle between an imaginary line extending from the first section and a longitudinal axis of the wedge. The second taper angle is defined by the angle between an imaginary line extending from the second section and a longitudinal axis of the wedge. The second taper angle is smaller than the first taper angle.

In yet another aspect, the invention provides for a wedge for an anchorage system for post-tensioned concrete reinforcement for an anchorage system including a tendon and an anchor. The anchor has a flange with a front surface and a rear surface. The anchor has at least one wedge receiving bore, the wedge receiving bore having a tapered interior surface. The wedge receiving bore extends through the flange portion of the anchor. The wedge comprises an internal surface configured to engage an outer surface of the tendon and an external surface configured to engage the tapered interior surface of the wedge receiving bore of the anchor. At least one of the internal surface or the external surface is shaped such that the compressive force on the tendon after tensioning of the anchorage system is substantially evenly distributed over a length of the outer surface of the tendon that is engaged by the internal surface of the wedge.

In still another aspect, the invention provides for a wedge for an anchorage system for post-tensioned concrete reinforcement for an anchorage system including a tendon and an anchor. The anchor has a flange with a front surface and a rear surface. The anchor has at least one wedge receiving bore, the wedge receiving bore having a tapered interior surface. The wedge receiving bore extends through the flange portion of the anchor. The wedge comprises an internal surface configured to engage an outer surface of the tendon and an external surface configured to engage the tapered interior surface of the wedge receiving bore of the anchor. The internal surface includes a thread pattern having a plurality of teeth and a flat valley section between adjacent teeth in the thread pattern.

In another aspect, the invention provides for a wedge for an anchorage system for post-tensioned concrete reinforcement for an anchorage system including a tendon and an anchor. The anchor has a flange with a front surface and a rear surface. The anchor has at least one wedge receiving bore, the wedge receiving bore having a tapered interior surface. The wedge receiving bore extends through the flange portion of the anchor. The wedge comprises an internal surface configured to engage an outer surface of the tendon and an external surface configured to engage the tapered interior surface of the wedge receiving bore of the anchor. The internal surface includes a thread pattern having a plurality of teeth with a tip having a radius.

In still another aspect, the invention provides for a wedge for an anchorage system for post-tensioned concrete reinforcement for an anchorage system including a tendon and an anchor. The anchor has a flange with a front surface and a rear surface. The anchor has at least one wedge receiving bore, the wedge receiving bore having a tapered interior surface. The wedge receiving bore extends through the flange portion of the anchor. The wedge comprises an internal surface configured to engage an outer surface of the tendon and an external surface configured to engage the tapered interior surface of the wedge receiving bore of the anchor. The internal surface includes a thread pattern having a plurality of teeth with a flattened tip.

In yet another aspect, the invention provides for an anchor for a post-tension concrete reinforcement. The anchor comprises a body that has a flange portion with a front surface and a rear surface. A bore extends through the flange portion. The bore has a first section with a first taper angle and a second section with a second taper angle. The first section is near the front surface and the second section is near the rear surface. The first taper angle is defined by the angle between an imaginary line extending from the first section and a longitudinal axis of the bore. The second taper angle is defined by the angle between an imaginary line extending from the second section and the longitudinal axis of the bore. The first section is configured to engage a wedge along substantially an entire length of the first section and the second section is configured to engage the wedge along substantially an entire length of the second section.

One advantage of the invention is that it provides for a wedge with a shape on the internal surface and/or external surface that help equally distribute the compressive force on the tendon over the length of its engagement with the internal surface of the wedge. Similarly, the invention provides for a bore with a shape that helps to equally distribute the compressive force on the wedge over the length of engagement between the bore and the wedge.

Another advantage of the invention is that it provides for threading patterns and tooth profiles that help to reduce the stress on the outer surface of the tendon.

An anchorage system employing one or more of these advantages for post-tensioned concrete results in a high performance anchorage system with efficiency above 95% and approaching 100% inclusive. Further, an anchorage system employing one or more of these advantages results in better cyclic loading performance or fatigue performance, such as the conditions in a seismic event. This increase in efficiency over prior art anchorage systems will help maintain the integrity of concrete structures and lead to longer life spans for such structures.

These and other features, aspects, and advantages of the present invention will become better understood upon consideration of the following detailed description, drawings, and appended claims.

DETAILED DESCRIPTION OF THE PREFERRED EMBODIMENT

Figure 1:
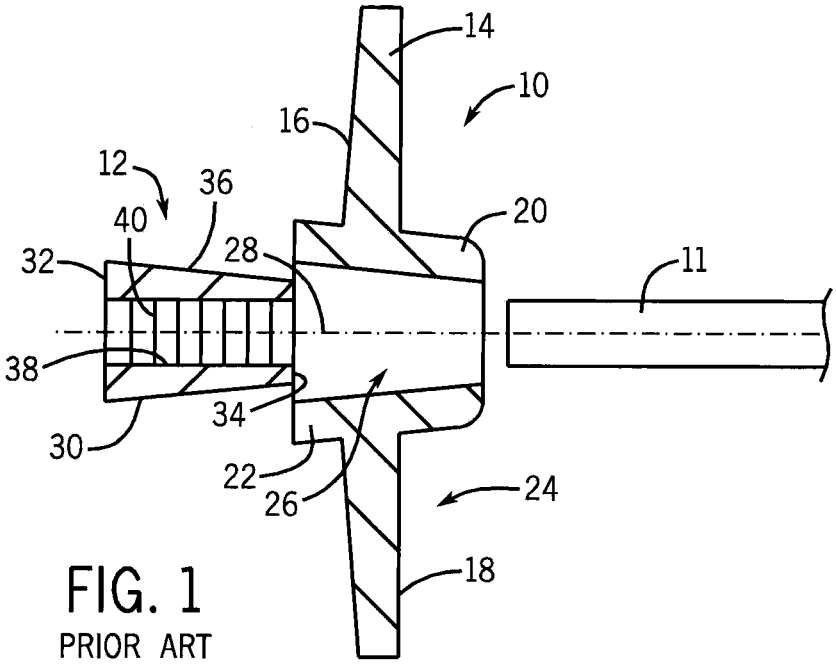
FIG. 1 PRIOR ART
FIG. 1 is a cross-section view showing a typical post-tension concrete anchor and wedge of the prior art.
Figure 2:
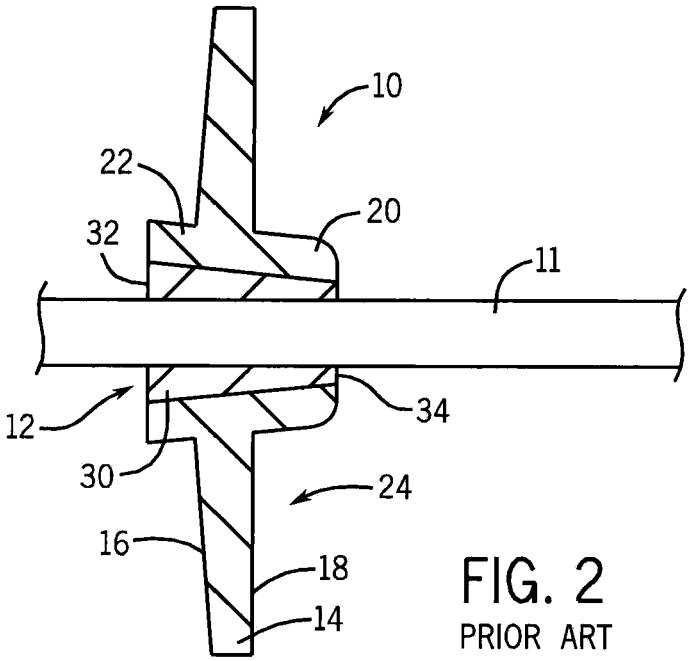
FIG. 2 PRIOR ART
FIG. 2 is a cross-section view showing the post-tension concrete anchor and wedge of FIG. 1 with the wedge inserted into the bore of the anchor.

Referring to FIGS. 1 and 2, an anchor 10 and wedge 12 for post-tension reinforcement of concrete that are typical of an anchorage system of the prior art are illustrated. The anchor 10 includes a body with a flange portion 14 that has both a front and rear surface 16, 18. The body also includes a button portion 20 and a nose portion 22. The button portion 20 extends from the rear surface 18 of the flange 14 and the nose portion 22 extends from the front surface 16 of the flange 14. The flange 14 extends laterally in both directions from both the nose portion 22 and the button portion 20. The extension of the flange 14 creates a bearing surface 24 on the rear surface 18 of the flange 14.

The anchor 10 also includes a bore 26 that extends through the nose portion 22, the flange portion 14, and the button portion 20. As shown in FIG. 1, the bore 26 has a diameter that tapers in the direction from the nose portion 22 to the button portion 20 to receive the wedge 12. In anchors typical of the prior art, the taper angle of the bore 26, as measured with the longitudinal axis 28 of the bore 26, is about 7°.

The wedge 12 is often constructed of two halves, but may be of unitary construction or includes more than two parts. One half 30 of the wedge 12 is shown in FIGS. 1 and 2, and while the other half is not shown, it is symmetrical to the half 30 shown. The wedge 12 has a front side 32 and rear side 34 and includes a tapering external surface 36 that tapers from the front side 32 to the rear side 34 of the wedge 12. The wedge 12 also has an internal surface 38 that may also be tapered. In the wedge 12 typical of the prior art, the external surface 36 tapers at an angle equal to the angle of taper of the bore 26 of the anchor 10.

As shown in FIG. 2, the wedge 12 is configured to cam against the bore 26 of the anchor 10 during post-tensioning of the tendon 11. To assist the wedge 12 in gripping the tendon 11, the internal surface 38 includes a thread pattern 40, as shown in FIG. 1. This post-tensioning transfers the tensile properties of the tendon 11 through to the wedge 12, the anchor 10, and ultimately, to the concrete structure itself.

Figure 3:
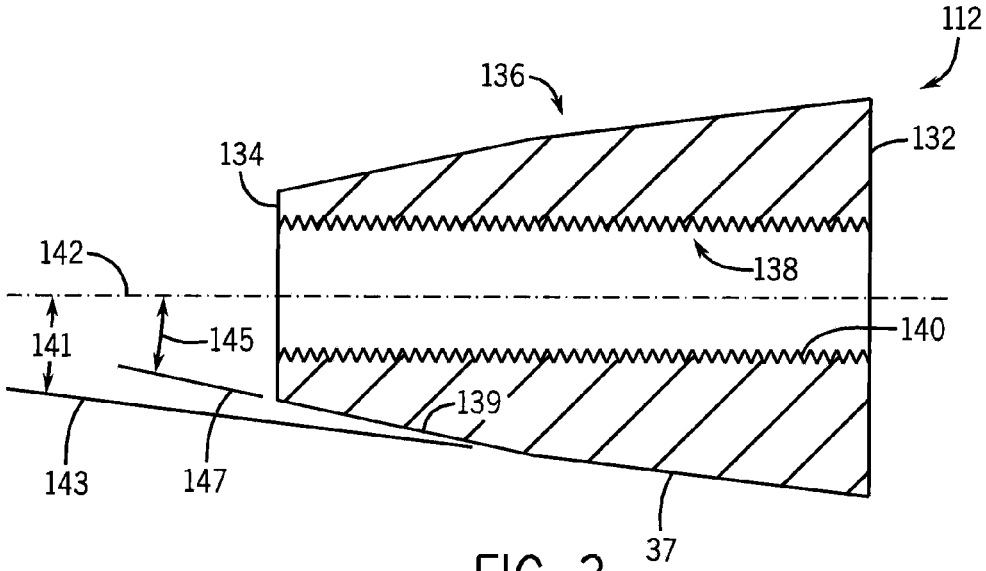
FIG. 3 is a cross-section view of a wedge embodying an aspect of the invention where the external surface of the wedge has two taper angles.

Turning now to FIG. 3, a wedge 112 embodying an aspect of the invention is shown. The wedge 112 has an external surface 136 and an internal surface 138 with a thread pattern 140. In this embodiment, the external surface 136 has a first section 137 and a second section 139. The first section 137 is near the front side 132 of the wedge 112 and the second section 139 is near the rear side 134 of the wedge 112. The first section 137 has a first taper angle 141 defined by the angle between an imaginary line 143 extending from the first section 137 and the longitudinal axis 142 of the wedge 112. The second section 139 has a second taper angle 145 defined by the angle between an imaginary line 147 extending from the second section 139 and the longitudinal axis 142 of the wedge 112. As shown in FIG. 3, the second taper angle 145 is larger than the first taper angle 141. In a preferred embodiment, the difference in taper angles 141, 145 may be less than or equal to about 1°. While the first section 137 is longer than the second section 139 of the external surface 136 of the wedge 112 in a direction parallel to the longitudinal axis 142 of the wedge 112, it is contemplated that the first section 137 may be shorter than the second section 139 or equal thereto.

The external surface 136 is shaped to include two taper angles 141, 145 to provide a wedge 112 that removes a high point of stress on the tendon near the rear side 134 of the wedge 112. The shaping of the external surface 136 of the wedge 112 more evenly distributes the compressive force of the wedge 112 on the tendon over the length of the outer surface of the tendon that engages the internal surface 138 of the wedge 112, and leads to an anchorage system with a higher level of efficiency.

Figure 4:
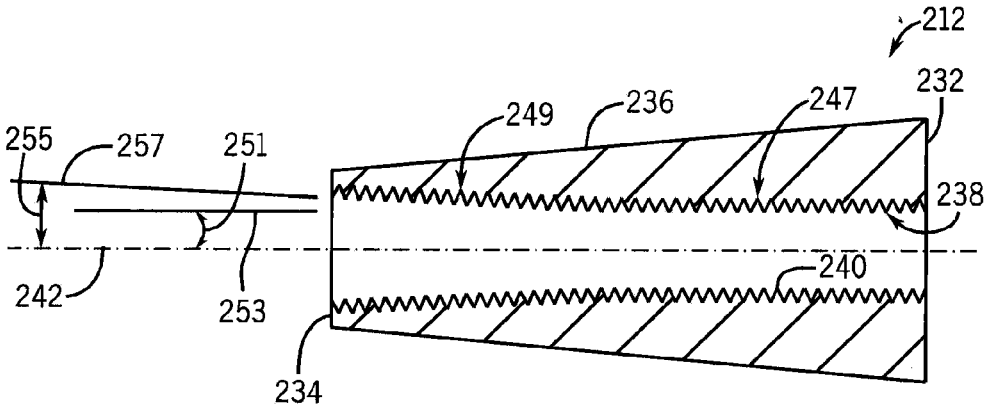
FIG. 4 is a cross-section view of a wedge embodying another aspect of the invention where the internal surface of the wedge has two taper angles.

Referring to FIG. 4, another aspect of the invention is shown. FIG. 4 illustrates a wedge 212 that has an external surface 236 and an internal surface 238 with a thread pattern 240. The external surface 236 tapers from the front side 232 to the rear side 234 of the wedge 212. The internal surface 238 includes a first section 247 and a second section 249. The first section 247 is near the front side 232 of the wedge 212 and the second section 249 is near the rear side 234 of the wedge 212. The first section 247 has a first taper angle 251 defined by the angle between an imaginary line 253 extending from the first section 247 and the longitudinal axis 242 of the wedge 212. The second section 249 includes a second taper angle 255 that is defined by the angle between an imaginary line 257 extending from the second section 249 and the longitudinal axis 242 of the wedge 212. The second section 249 tapers away from the longitudinal axis 242 in a direction from the front side 232 to the rear side 234 of the wedge 212. In the embodiment shown in FIG. 4, the second taper angle 255 is greater than the first taper angle 251. The difference between the second taper angle 255 and the first taper angle 251 of the internal surface 238 of the wedge 212 may be less than or equal to about 1°. The first section 247 is longer than the second section 249, as measured in a direction parallel to the longitudinal axis 242 of the wedge 212. However, it is contemplated that the first section 247 may be shorter than or equal to the second section 249.

It is contemplated that the imaginary line 253 that extends from the first section 247 of the internal surface 238 of the wedge 212 may be parallel to the longitudinal axis 242 of the wedge 212. In such a circumstance, there is no intersection between the axis 242 and such a line 253 extending from the first section 247, and thus, no angle between the axis 242 and line 253. However, for the purposes of this disclosure, such a situation will be addressed by referring to the first taper angle 251 to be 0°.

Similar to that as described above regarding the two taper angles 141, 145 on the external surface 136 of the wedge 112 in FIG. 3, the construction of a wedge 212 with two taper angles 251, 255 on the internal surface 238 as shown in FIG. 4 more equally distributes the compressive force on the tendon over the length of its engagement with the thread pattern 240 on the internal surface 238 of the wedge 212. By doing so, a higher efficiency anchorage system may be realized.

Figure 5:
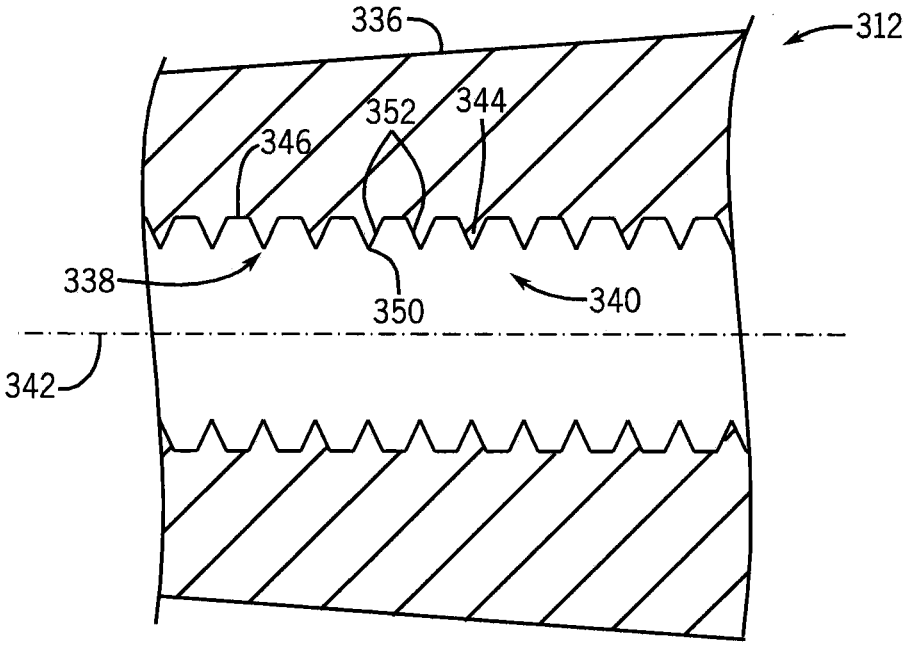
FIG. 5 is a cross-section of a portion of a wedge embodying other aspects of the invention where the thread pattern has flat valley sections between adjacent teeth and the teeth have a tip with a radius.

Another embodiment of a wedge 312 according to the invention is shown in FIG. 5. The wedge 312 includes an external surface 336 and an internal surface 338 with a thread pattern 340. The thread pattern 340 includes a plurality of teeth 344. As shown in FIG. 5, the teeth 344 have a radiused tip 350. The thread pattern 340 also includes a flat valley section 346 between adjacent teeth 344.

A thread pattern 340 that includes teeth 344 having a radiused tip 350 is beneficial in helping reduce the stress level on the outer surface of the tendon during the engagement between the tendon and the internal surface 338 of the wedge 312. The radius on the tip 350 of teeth 344 is preferred to be 0.005 inches, but of course, the radius may be set to other values. The rounded profile of the teeth 344 helps increase the area of contact between the tip 350 of the teeth 344 and the tendon. By increasing this area of contact, the stress on the tendon at each tooth 344 is reduced, and by doing so, the depth of penetration of the tooth 344 into the tendon may be reduced as well. This reduction in stress on the tendon increases the integrity of the tendon over time, and ultimately, may increase the efficiency of an anchorage system employing such a tooth 344 profile.

In addition, the flat valley sections 346 in the thread pattern 340 help to maximize the amount of control over the depth that the teeth 344 penetrate into the tendon, or the amount of "bite" the teeth 344 display. As shown in FIG. 5, the thread pattern 340 includes teeth 344 that have a sloping side 352 on each side of the rounded tip 350. On two adjacent teeth 344, sloping sides 352 intersect the flat valley section 346. During tensioning of the tendon, the depth of penetration of the teeth 344 is limited by the flat valley section 346 in the thread pattern 340. Once the tendon reaches the flat valley section 346, the wedge 312 can no longer "bite" or penetrate into the tendon. If a tooth 344 penetrates too far into the tendon, excess stress will be created at that point. Thus, by providing a thread pattern 340 with a flat valley section 346, the level of penetration of the teeth 346 into the tendon may be controlled and the amount of shear stress on the tendon can be reduced. Because the depth of penetration into the tendon relates to the stress concentrations in the tendon, using a thread pattern 340 with flat valley sections 346 that provide more control over penetration leads to an anchorage system with higher efficiency.

Figure 6:
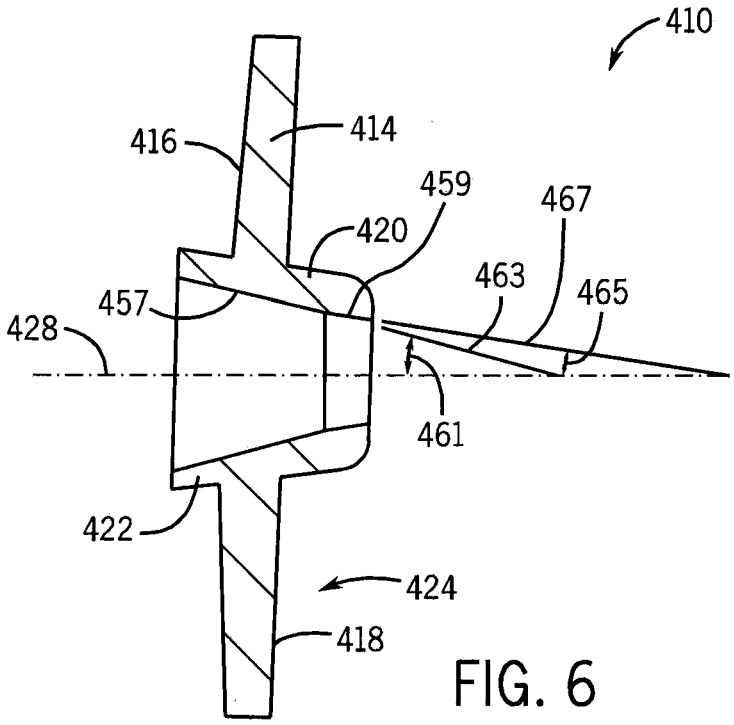
FIG. 6 is a cross-section of an anchor embodying an aspect of the invention where the bore has two taper angles.

FIG. 6 shows an anchor 410 embodying another aspect of the invention. The anchor 410 has a flange 414 with a front surface 416 and rear surface 418. The anchor 410 has a nose portion 422 and a button portion 420, with a bore 426 passing through nose portion 422, the flange 414, and the button portion 420. The flange 414 extends laterally in both directions from both the nose portion 422 and the button portion 420. This extension of the flange 414 creates a bearing surface 424 on the rear surface 418 of the flange 414.

The bore 426 of anchor 460 has a first section 457 and a second section 459. The first section 457 is near the nose portion 422 and the second section 459 is near the button portion 420. The first section 457 has a first taper angle 461 defined by the angle between an imaginary line 463 extending from the first section 457 and the longitudinal axis 428 of the bore 426. The first section 457 converges in a direction from the nose portion 422 to the button portion 420. The second section 459 has a second taper angle 465 defined by the angle between an imaginary line 467 extending from the second section 459 and the longitudinal axis 428 of the bore 426. The second section 459 also converges in a direction from the nose portion 422 to the button portion 420, however, the second taper angle 465 is smaller than the first taper angle 461. The difference between taper angles 465, 461 may be less than or equal to about 1°. The first section 457 is longer than the second section 459 in a direction parallel to the longitudinal axis 428 of the bore 426. However, it is contemplated that the first section 457 may be shorter than or equal to the second section 459.

As described above with respect to the different taper angles 141, 145 of the external surface 136 of wedge 112 in FIG. 3 and the different taper angles 251, 255 of the internal surface 138 of wedge 212 in FIG. 4, the different taper angles 461 and 465 of the bore 426 in anchor 410 help to more equally distribute the compressive force on a wedge in the bore 426 over the length of the bore 426. Unlike bores of anchors that have two sections with different taper angles, with the lesser taper angle being located near the rear end of the anchor only to protect the sheathing on the tendon from nicks and abrasions and not to engage the wedge, anchor 426 has a small difference in taper angles 461, 465 to allow substantially the entire length of the second section 459 of the bore 426 (in addition to substantially an entire length of the first section 457) to engage an external surface of a wedge during post-tension reinforcement. Distributing the compressive load from the wedge more equally over the length of the bore 426 helps to increase the efficiency of the anchorage system.

Figure 7:
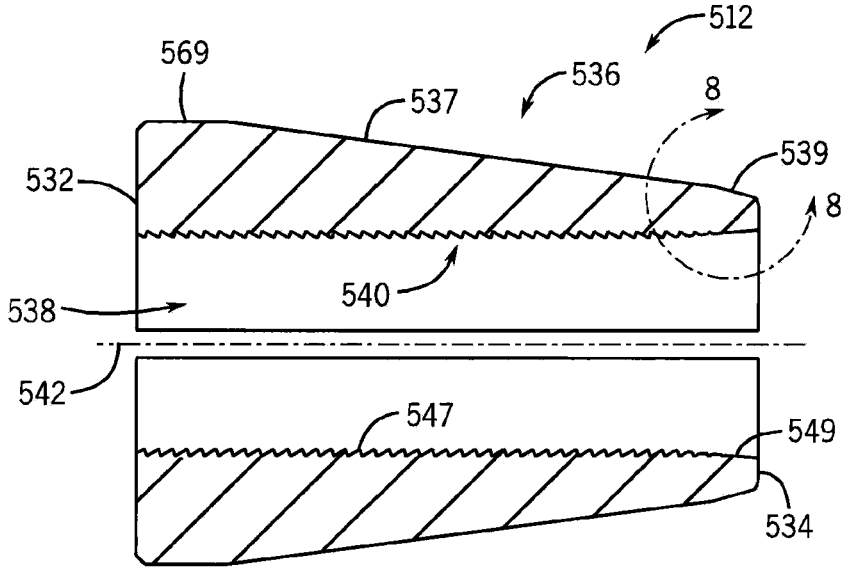
FIG. 7 is a cross-section view of a wedge embodying another aspect of the invention where the external surface of the wedge has a non-tapered section, a first section with a first taper angle, and a second section with a second taper angle.
Figure 8:
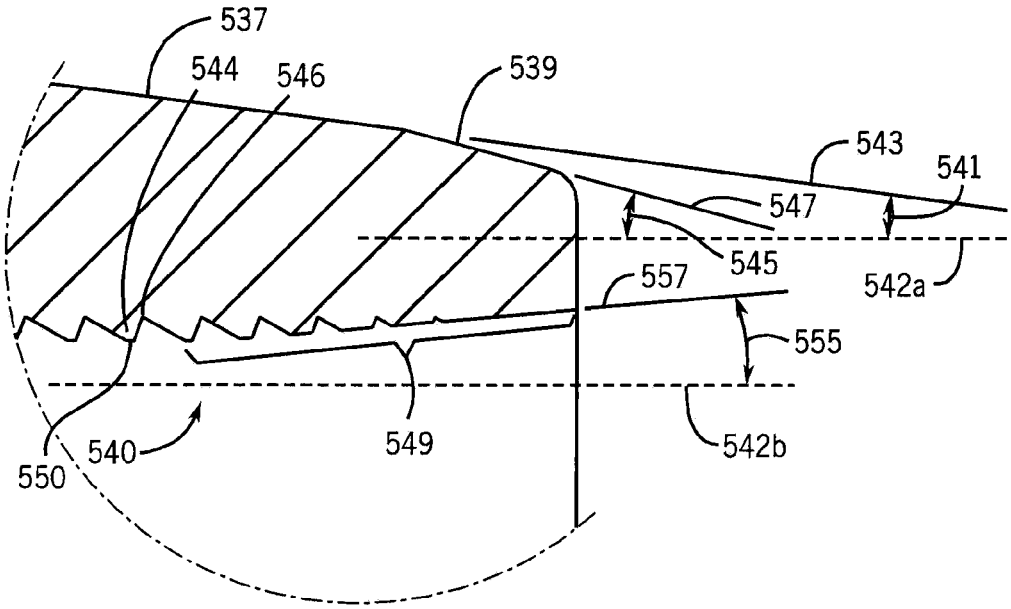
FIG. 8 is a detailed view of a portion of FIG. 7.

Referring to FIGS. 7 and 8, another embodiment of a wedge 512 is shown. The wedge 512 has an external surface 536 and an internal surface 538 with a thread pattern 540. The external surface 536 includes a non-tapered section 569, which is parallel to the longitudinal axis 542 of the wedge 512. The non-tapered section 569 is near the front side 532 of the wedge 512. The external surface 536 also includes a first section 537 with a first taper angle 551 and a second section 539 with a second taper angle 545. The first section 537 is near the front side 532 of the wedge 512 and the second section 539 is near the rear side 534 of the wedge 512. The first taper angle 541 is defined by the angle between an imaginary line 543 extending from the first section 537 and the longitudinal axis 542 of the wedge 542. The second taper angle 545 is defined by an imaginary line 547 extending from the second section 539 and the longitudinal axis 542. For purposes of showing the first and second taper angles 541, 545 in the detailed view of FIG. 8, an axis **542*a* parallel to the longitudinal axis 542 is shown. In a preferred embodiment, the first taper angle 541 is about 7° 30' and the second taper angle 545** is about 15°.

The internal surface 538 of wedge 512 includes a first section 547 near the front side 532 and a second section 549 near the rear side 534 of the wedge 512. The first section 547 forms a first taper angle 551 with the longitudinal axis 542. In the embodiment shown in FIGS. 7 and 8, the first taper angle 551 is considered to be 0° because the first section 547 is parallel to the longitudinal axis 542. The second section 549 includes a second taper angle 555 that is defined between an imaginary line 557 extending from the second section 549 and the longitudinal axis 542. The second taper angle 555 may be about 5°. For purposes of showing the second taper angle 555 in the detailed view of FIG. 8, an axis **542*b* parallel to the longitudinal axis 542** is shown.

As best shown in FIG. 8, the thread pattern 540 of wedge 512 includes teeth 544 that have a flattened tip 550, with sharp valleys 546 between adjacent teeth 544. The flattened tip 550 increases the area of contact between the tip 550 of the teeth 544 and the tendon, similar to the radiused tip 350 of the thread pattern 340 discussed above with respect to FIG. 5. As previously discussed, increasing the area of contact between the teeth 544 and the tendon reduces the stress on the tendon at each tooth 544, reducing the depth of penetration of the tooth 544 into the tendon and ultimately increasing the efficiency of an anchorage system employing such a tooth 544 profile. As shown in FIG. 8, the flattened tip 550 becomes increasing larger for the teeth 544 that are closer to the rear end 534 of the wedge 512. Such a configuration is achieved because the thread pattern 540 is first constructed in the internal surface 538, with the internal surface 538 having a continuous taper angle equal to the taper angle of the first section 547. Then a tool is used to bore the second taper angle 555 of the second section 549, which affects the thread pattern 540 and the tooth 544 profile in the second section 549 as shown in FIG. 8.

Figure 9:
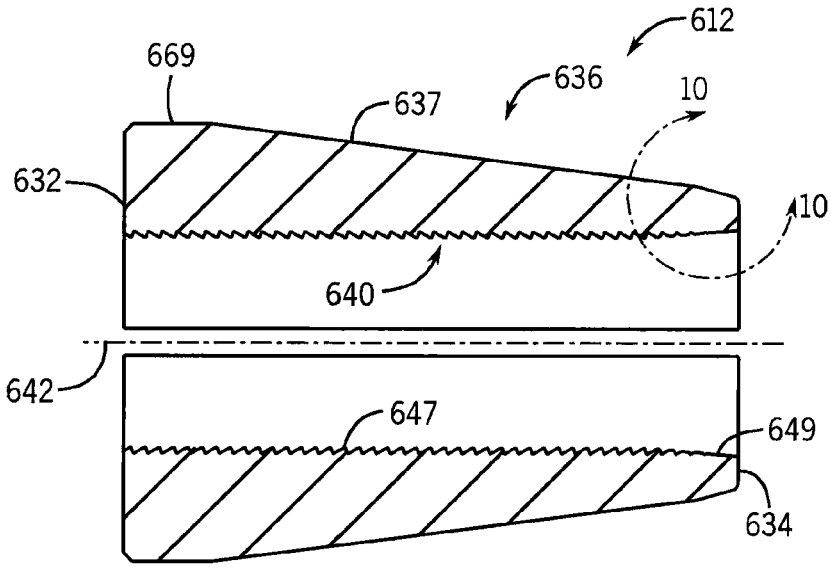
FIG. 9 is a cross-section view of a wedge embodying another aspect of the invention where the external surface of the wedge has a non-tapered section, a first section with a first taper angle, a second section with a second taper angle, and a third section with a third taper angle.
Figure 10:
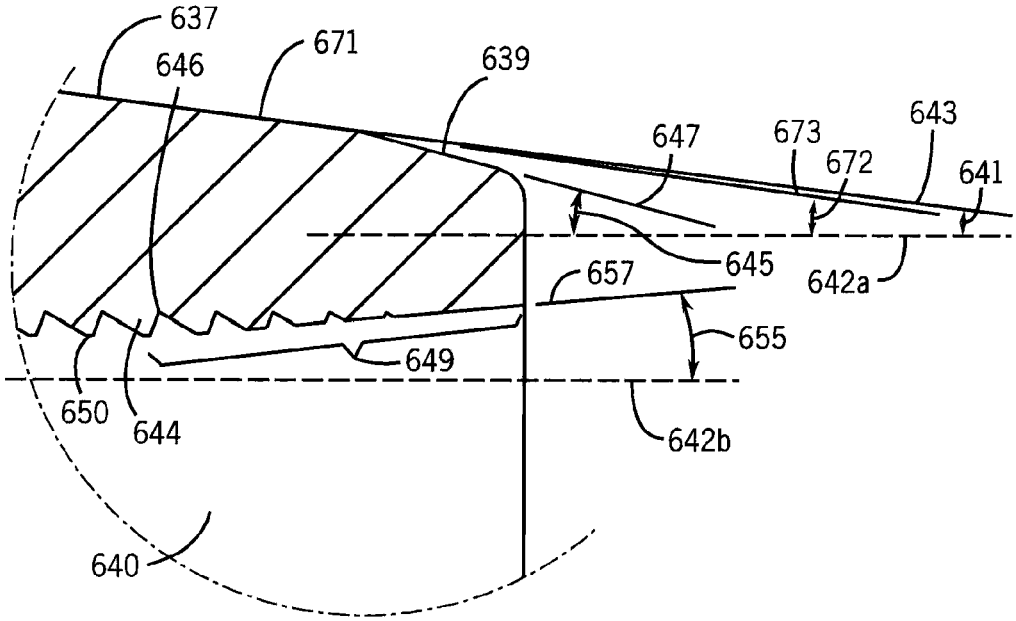
FIG. 10 is a detailed view of a portion of FIG. 9.

FIGS. 9 and 10 illustrate another embodiment of a wedge 612. The wedge 612 has an external surface 636 and an internal surface 638 with a thread pattern 640. The external surface 636 of wedge 612 includes a non-tapered section 669, which is parallel to the longitudinal axis 642 of the wedge 612. The non-tapered section 669 is near the front side 632 of the wedge 612. The external surface 636 also includes a first section 637 near the front side 632 of the wedge 612 and a second section 639 near the rear side 634 of the wedge 612. The external surface 636 also includes a third section 671 that is located between the first section 637 and the second section 639. The first section 637 has a first taper angle 651 defined by the angle between an imaginary line 643 extending from the first section 637 and the longitudinal axis 642 of the wedge 642. The second section 639 has a second taper angle 645 defined by an imaginary line 647 extending from the second section 639 and the longitudinal axis 642. The third section 671 has a third taper angle 672 defined by the angle between an imaginary line 673 extending from the third section 671 and the longitudinal axis. For purposes of showing the first, second, and third taper angles 641, 645, 672 in the detailed view of FIG. 10, an axis 642*a* parallel to the longitudinal axis 542 is shown. The first taper angle 641 is less than the second taper angle 645 and the third taper angle 672. The third taper angle 672 is less than the second taper angle 645. In a preferred embodiment, the first taper angle 641 is about 7° 20', the second taper angle 645 is about 15°, and the third taper angle 672 is about 7° 30'.

The internal surface 638 of wedge 612 is similar to the wedge 512 described above with respect to FIGS. 7 and 8. Thus, the wedge 612 includes a first section 647 with a first taper angle 651 and a second section 647 with a second taper angle 655. The first taper angle 651 is considered to be 0° because the first section 647 is parallel to the longitudinal axis 642. The second taper angle 655 is defined between imaginary line 657 extending from the second section 651 and axis 642*b*, which is parallel to the longitudinal axis 642 of the wedge 612. Additionally, the thread pattern 640 of the wedge 612 is the same as the thread pattern 540 of wedge 512 described above, and includes teeth 644 having flattened tips 650 and sharp valleys 646 between adjacent teeth 644.

Figure 11:
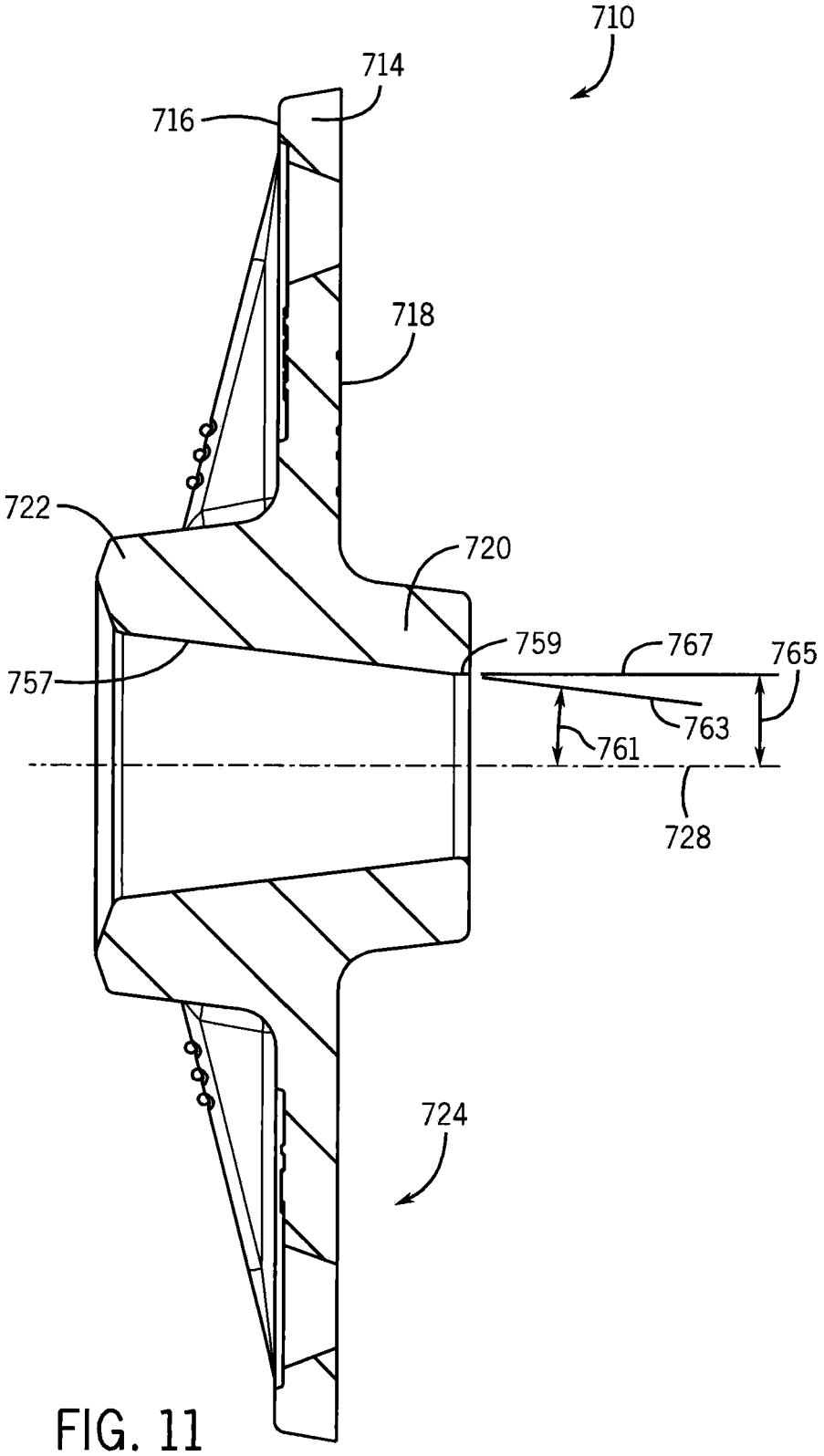
FIG. 11 is a cross-section view of a post tension concrete anchor.

FIG. 11 illustrates an anchor 710. The anchor 710 includes a body with a flange portion 714 that has both a front and rear surface 716, 718. The body also includes a button portion 720 and a nose portion 722. The button portion 720 extends from the rear surface 718 of the flange 714 and the nose portion 722 extends from the front surface 716 of the flange 714. The flange 714 extends laterally in both directions from both the nose portion 722 and the button portion 720. The extension of the flange 714 creates a bearing surface 724 on the rear surface 718 of the flange 714.

The anchor 710 also includes a bore 726 that extends through the nose portion 722, the flange portion 714, and the button portion 720. As shown in FIG. 11, the bore 726 has a first section 757 and a second section 759. The first section 757 is near the nose portion 722 and the second section 759 is near the button portion 720. The first section 757 has a first taper angle 761 defined by the angle between an imaginary line 763 extending from the first section 757 and the longitudinal axis 728 of the bore 726. The first section 757 converges towards the longitudinal axis 728 of the bore 726 in a direction from the nose portion 722 to the button portion 720. The second section 759 has a second taper angle 765 defined by the angle between an imaginary line 767 extending from the second section 759 and the longitudinal axis 728 of the bore 726. The second section 759 can be parallel to the longitudinal axis 728 of the bore 726 or diverge from the longitudinal axis in a direction from the nose portion 722 to the button portion 720. The difference between taper angles 765, 761 may be less than or equal to about 1°. The first section 757 is longer than the second section 759 in a direction parallel to the longitudinal axis 728 of the bore 726. The anchor 710 as illustrated in FIG. 11 may be used with any of the previously discussed wedges 112, 212, 312, 512, and 612 as part of a high performance anchorage system.

Although the various aspects of the invention were discussed individually and shown on different embodiments in the figures, it is contemplated that several, or even all, of the previously discussed aspects of the invention may be combined and used in a post-tension reinforcement system at the same time to create a high performance anchorage system. As but one non-limiting example of how different aspects discussed above can be combined, a wedge including an internal surface with two different taper angles and an external surface with two different taper angles can be used with an anchor that includes a bore having two different taper angles. Of course, other combinations of the aspects discussed above are contemplated to create a high performance anchorage system. Testing has shown that using various aspects of the invention discussed herein may lead to anchorage systems above 95% efficiency.

While this description defines, refers to, or characterizes certain surfaces, edges, and components using descriptive terms including, but not limited to, parallel, and perpendicular, such a relationship is fulfilled when it is as close to that condition as the manufacturing methods of producing the previously discussed anchorage system components will allow under normal operating conditions. Furthermore, the figures shown in this description are not necessarily drawn to scale.

The foregoing description was primarily directed to preferred embodiments of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not be limited by the above disclosure.

The invention claimed is:

1. A wedge for an anchorage system for post-tensioned concrete reinforcement, the anchorage system including a tendon and an anchor having a flange with a front surface and a rear surface, the anchor having at least one wedge receiving bore, the wedge receiving bore having a tapered interior surface, the wedge receiving bore extending through the flange portion, the wedge comprising:

an internal surface formed prior to contact with the tendon so as to contract as the wedge is drawn into the wedge receiving bore and engage an outer surface of the tendon; and an external surface formed prior to contact with the tapered interior surface of the wedge receiving bore of the anchor to contract as the wedge is drawn into the wedge receiving bore, the external surface so formed so as to include:

a first section with a first taper angle, the first taper angle being defined by the angle between an imaginary line extending from the first section and a longitudinal axis of the wedge, and a second section with a second taper angle, the second taper angle being defined by the angle between an imaginary line extending from the second section and the longitudinal axis of the wedge, the second taper angle being larger than the first taper angle, the first section being near a front side of the wedge and the second section being near a rear side of the wedge;

wherein the internal surface includes a first section with a first taper angle, the first taper angle of the internal surface being defined by the angle between an imaginary line extending from the first section of the internal surface and the longitudinal axis of the wedge, and a second section with a second taper angle, the second taper angle of the internal surface being defined by the angle between an imaginary line extending from the second section of the internal surface and the longitudinal axis of the wedge, the first taper angle of the internal surface being less than the second taper angle of the internal surface, the first section of the internal surface being near a front side of the wedge and the second section of the internal surface being near a rear side of the wedge so as to equalize the distribution of compressive forces over the first and second sections.

2. The wedge of claim 1, wherein a difference between the second taper angle and the first taper angle of the external surface is less than or equal to about one degree.

3. The wedge of claim 1, wherein the first section of the external surface is longer than the second section of the external surface in a direction parallel to the longitudinal axis of the wedge.

4. The wedge of claim 1 wherein a difference between the second taper angle and the first taper angle of the external surface is less than or equal to about one degree and a difference between the second taper angle and the first taper angle of the internal surface is less than or equal to about one degree.

5. The wedge of claim 1, wherein the second section of the internal surface tapers away from the longitudinal axis in a direction from the front side of the wedge to the rear side of the wedge.

6. The wedge of claim 1, wherein the internal surface includes a thread pattern having a plurality of teeth and a flat valley section between adjacent teeth in the thread pattern.

7. The wedge of claim 1, wherein the internal surface includes a thread pattern having a plurality of teeth with a tip having a radius.

8. The wedge of claim 1, wherein the internal surface includes a thread pattern having a plurality of teeth with a flattened tip.

9. The wedge of claim 1, wherein the external surface further includes a third section with a third taper angle, the third section being between the first section and the second section of the external surface, the third taper angle being greater than the first taper angle of the first section of the external surface and less than the second taper angle of the second section of the external surface.

10. The wedge of claim 1, wherein the external surface further includes a non-tapered section, the non-tapered section being near the front side of the wedge.

11. A wedge for an anchorage system for post-tensioned concrete reinforcement, the anchorage system including a tendon and an anchor having a flange with a front surface and a rear surface, the anchor having at least one wedge receiving bore, the wedge receiving bore having a tapered interior surface, the wedge receiving bore extending through the flange portion, the wedge comprising:

an internal surface formed prior to contact with the tendon so as to contract as the wedge is drawn into the wedge receiving bore and engage an outer surface of the tendon, the internal surface so formed so as to include:

a first section with a first taper angle, the first taper angle being defined by the angle between an imaginary line extending from the first section and a longitudinal axis of the wedge, and a second section with a second taper angle, the second taper angle being defined by the angle between an imaginary line extending from the second section and the longitudinal axis of the wedge, the first taper angle being less than the second taper angle, the first section being near a front side of the wedge and the second section being near a rear side of the wedge; and an external surface formed prior to contact with the wedge receiving bore to engage the tapered interior surface of the wedge receiving bore of the anchor and contract as the wedge is drawn into the wedge receiving bore;

wherein the internal surface includes a first section with a first taper angle, the first taper angle of the internal surface being defined by the angle between an imaginary line extending from the first section of the internal surface and the longitudinal axis of the wedge, and a second section with a second taper angle, the second taper angle of the internal surface being defined by the angle between an imaginary line extending from the second section of the internal surface and the longitudinal axis of the wedge, the first taper angle of the internal surface being less than the second taper angle of the internal surface, the first section of the internal surface being near a front side of the wedge and the second section of the internal surface being near a rear side of the wedge so as to equalize the distribution of compressive forces over the first and second sections.

12. The wedge of claim 11, wherein a difference between the second taper angle and the first taper angle is less than or equal to about one degree.

13. The wedge of claim 11, wherein the first section is longer than the second section in a direction parallel to the longitudinal axis of the wedge.

14. The wedge of claim 11, wherein the internal surface includes a thread pattern having a plurality of teeth and a flat valley section between adjacent teeth in the thread pattern.

15. The wedge of claim 11, wherein the internal surface includes a thread pattern having a plurality of teeth with a tip having a radius.

16. The wedge of claim 11, wherein the internal surface includes a thread pattern having a plurality of teeth with a flattened tip.

17. The wedge of claim 11, wherein the second section tapers away from the longitudinal axis in a direction from the front side of the wedge to the rear side of the wedge.

18. An anchor for a post-tension concrete reinforcement, the anchor comprising:

a body having a flange portion with a front surface and a rear surface; and a bore extending through the flange portion, the bore having a first section with a first taper angle and a second section with a second taper angle, the first and second sections being formed prior to contact with a wedge which is received by the bore, the first section being near the front surface and the second section being near the rear surface, the first taper angle being defined by the angle between an imaginary line extending from the first section and a longitudinal axis of the bore, the second taper angle being defined by the angle between an imaginary line extending from the second section and the longitudinal axis of the bore, the first section configured to engage a wedge along substantially an entire length of the first section, the second section configured to engage the wedge along substantially an entire length of the second section so as to equalize the distribution of compressive forces over the first and second sections;

wherein, the length of the second section is less than one tenth the length of the first section.

19. The anchor of claim 18, wherein a difference between the first taper angle and the second taper angle is less than or equal to about one degree.

20. The anchor of claim 18, wherein the first section is longer than the second section in a direction parallel to the longitudinal axis of the anchor.

* * * * *